US009472363B2

(12) United States Patent
Takeda

(10) Patent No.: US 9,472,363 B2
(45) Date of Patent: Oct. 18, 2016

(54) THERMAL PROTECTOR

(71) Applicant: Uchiya Thermostat Co., Ltd., Saitama (JP)

(72) Inventor: Hideaki Takeda, Saitama (JP)

(73) Assignee: Uchiya Thermostat Co., Ltd., Saitama-Ken (JP)

( * ) Notice: Subject to any disclaimer, the term of this patent is extended or adjusted under 35 U.S.C. 154(b) by 222 days.

(21) Appl. No.: 14/310,734

(22) Filed: Jun. 20, 2014

(65) Prior Publication Data

US 2014/0300445 A1 Oct. 9, 2014

Related U.S. Application Data

(62) Division of application No. 13/203,960, filed as application No. PCT/JP2009/007053 on Dec. 21, 2009, now Pat. No. 9,000,880.

(30) Foreign Application Priority Data

Mar. 12, 2009 (JP) ..... 2009-0588835

(51) Int. Cl.
*H01H 37/52* (2006.01)
*H01H 71/16* (2006.01)
*H01H 37/54* (2006.01)

(52) U.S. Cl.
CPC ..... *H01H 37/52* (2013.01); *H01H 37/54* (2013.01); *H01H 71/16* (2013.01); *H01H 2037/5481* (2013.01)

(58) Field of Classification Search
CPC ..... H01H 37/54; H01H 37/52; H01H 71/16; H01H 2037/5481
USPC ..... 337/16, 36, 85, 102, 105, 333, 362, 337/372, 377
See application file for complete search history.

(56) References Cited

U.S. PATENT DOCUMENTS 3,430,177 A * 2/1969 Audette ..... H01H 37/5418 29/622
3,443,259 A * 5/1969 Wehl ..... H01H 37/5418 337/368

(Continued)

FOREIGN PATENT DOCUMENTS

DE 10030711 A1 2/2001
GB 2295925 A 6/1996

(Continued)

OTHER PUBLICATIONS

"U.S. Appl. No. 13/203,960, Non Final Office Action mailed Dec. 26, 2013", 10 pgs.

(Continued)

*Primary Examiner* — Anatoly Vortman
(74) *Attorney, Agent, or Firm* — Schwegman Lundberg & Woessner, P.A.

(57) ABSTRACT

A thermal protector has superiority in current responsiveness or thermal responsiveness with a simple configuration that does not need a separate manufacturing step of incorporating a resistor. At a stage of press processing for cutting from an original material, a movable plate body part of a movable plate is partitioned into a narrow-width part and a wide-width part by a slim hole. The movable plate is assembled to a fixed conductor with columns of an insulator, a bimetal is assembled to the movable plate, the entire configuration is pressed down by a resinous block, and the entire fixing part is fixed by melting tips of the columns. The wide-width part serves as a normal movable plate, whereas the narrow-width part serves as a conductor in a normal state and as a resistor against an overcurrent.

2 Claims, 9 Drawing Sheets

(56) References Cited

U.S. PATENT DOCUMENTS

| | | | | |
|---|---|---|---|---|
| 3,559,016 | A | 1/1971 | Gerteis | |
| 3,840,834 | A | 10/1974 | Obenhaus et al. | |
| 4,092,573 | A | 5/1978 | D'entremont | |
| 4,278,960 | A | 7/1981 | Muller et al. | |
| 4,414,529 | A * | 11/1983 | Yoshioka | H01H 37/006 337/36 |
| 4,620,175 | A * | 10/1986 | Karr | H01H 37/5427 337/343 |
| 4,862,133 | A * | 8/1989 | Tabei | H01H 1/504 337/102 |
| 5,247,273 | A | 9/1993 | Shibayama et al. | |
| 5,621,376 | A * | 4/1997 | Takeda | H01H 37/52 29/622 |
| 5,689,173 | A | 11/1997 | Oosaki et al. | |
| 5,757,262 | A * | 5/1998 | Takeda | H01H 37/5418 337/333 |
| 5,804,798 | A | 9/1998 | Takeda | |
| 5,847,637 | A | 12/1998 | Takeda et al. | |
| 6,281,780 | B1 | 8/2001 | Sugiyama et al. | |
| 6,316,878 | B1 | 11/2001 | Tsukada | |
| 6,346,796 | B1 | 2/2002 | Takeda | |
| 6,396,381 | B1 | 5/2002 | Takeda | |
| 6,414,285 | B1 | 7/2002 | Takeda | |
| 6,633,222 | B2 | 10/2003 | Nagai et al. | |
| 6,756,876 | B2 | 6/2004 | Sullivan et al. | |
| 7,026,907 | B2 | 4/2006 | Takeda | |
| 7,330,097 | B2 | 2/2008 | Takeda | |
| 8,237,536 | B2 * | 8/2012 | Takeda | H01H 37/5418 337/340 |
| 8,289,124 | B2 | 10/2012 | Hofsaess | |
| 8,958,196 | B2 | 2/2015 | Takeda | |
| 2003/0058079 | A1 | 3/2003 | Sulliva et al. | |
| 2012/0001721 | A1 | 1/2012 | Takeda | |
| 2012/0032773 | A1 | 2/2012 | Takeda | |
| 2012/0212210 | A1 | 8/2012 | Takeda | |
| 2014/0300443 | A1 | 10/2014 | Takeda | |

FOREIGN PATENT DOCUMENTS

| | | | |
|---|---|---|---|
| JP | 6431643 | U | 2/1989 |
| JP | 620571 | A | 1/1994 |
| JP | 11-86803 | A | 3/1999 |
| JP | 1186703 | A | 3/1999 |
| JP | 11-297173 | A | 10/1999 |
| JP | 11-341677 | A | 12/1999 |
| JP | 2000-323103 | A | 11/2000 |
| JP | 2002-204525 | A | 7/2002 |
| JP | 3393981 | B2 | 4/2003 |
| JP | 2003141977 | A | 5/2003 |
| JP | 2003-203803 | A | 7/2003 |
| JP | 2004-080419 | A | 3/2004 |
| JP | 2004-133568 | A | 4/2004 |
| JP | 2005237124 | A | 9/2005 |
| JP | 2005-274886 | A | 10/2005 |
| JP | 2006-202078 | A | 8/2006 |
| WO | WO-2005081276 | A1 | 9/2005 |
| WO | WO-2010103590 | A1 | 9/2010 |
| WO | WO-2010103599 | A1 | 9/2010 |
| WO | WO-2011/055577 | A1 | 5/2011 |

OTHER PUBLICATIONS

"U.S. Appl. No. 13/203,960, Notice of Allowance mailed May 12, 2014", 10 pgs.
"U.S. Appl. No. 13/203,960, Response filed Nov. 11, 2013 to Restriction Requirement mailed Oct. 10, 2013", 9 pgs.
"U.S. Appl. No. 13/203,960, Restriction Requirement mailed Oct. 10, 2013", 6 pgs.
"U.S. Appl. No. 13/254,698, Non Final Office Action mailed Oct. 15, 2013", 15 pgs.
"Chinese Application Serial No. 200980157811.X, Office Action dated Jul. 3, 2013", (w/ English Translation), 7 pgs.
"International Application Serial No. PCT/JP2009/005986, International Preliminary Report on Patentability dated Oct. 18, 2011", (w/ English Translation), 11 pgs.
"International Application Serial No. PCT/JP2009/005986, International Search Report mailed Dec. 22, 2009", (w/ English Translation), 2 pgs.
"International Application Serial No. PCT/JP2009/005986, Written Opinion mailed Dec, 22, 2009", (w/ English Translation), 9 pgs.
"International Application Serial No. PCT/JP2009/007053, International Preliminary Report on Patentability dated Oct. 18, 2011", (w/ English Translation), 8 pgs.
"International Application Serial No. PCT/JP2009/007053, International Search Report mailed Jan. 19, 2010", (w/ English Translation), 3 pgs.
"International Application Serial No. PCT/JP2009/007053, Written Opinion mailed Jan. 19, 2010", (w/ English Translation), 9 pgs.
"U.S. Appl. No. 13/203,960, Notice of Allowance mailed Dec. 5, 2014", 9 pgs.
"U.S. Appl. No. 13/203,960, Response filed Mar. 26, 2014 to Non Final Office Action mailed Dec. 26, 2013", 8 pgs.
"U.S. Appl. No. 13/503,238, Non Final Office Action mailed May 22, 2014", 7 pgs.
"U.S. Appl. No. 13/503,238, Notice of Allowance mailed Sep. 29, 2014", 9 pgs.
"U.S. Appl. No. 13/503,238, PTO Response to 312 Communication mailed Jan. 20, 2015", 3 pgs.
"U.S. Appl. No. 13/503,238, Response filed Aug. 22, 2014 to Non Final Office Action mailed May 22, 2014", 12 pgs.
"Chinese Application Serial No. 201080048779.4, Second Notice of the Opinion mailed Mar. 20, 2014", (w/ English Translation), 9 pgs.
"International Application Serial No. PCT/JP2010/063199, International Preliminary Report on Patentability dated May 8, 2012", (w/ English Translation), 10 pgs.
"International Application Serial No. PCT/JP2010/063199, International Search Report mailed Nov. 9, 2010", 2 pgs.
"International Application Serial No. PCT/JP2010/063199, Written Opinion mailed Nov. 9, 2010", (w/ English Translation), 8 pgs.
"German Application Serial No. 112009004858.7, Office Action mailed Oct. 1, 2015", (w/ English Translation), 17 pgs.
"German Applications Serial No. 112009004500.6, Office Action mailed Oct. 1, 2015", (w/ English Translation), 16 pgs.

* cited by examiner

THERMAL PROTECTOR

PRIORITY APPLICATIONS

This application is divisional application of U.S. application Ser. No. 13/203,960, filed Aug. 30, 2011, which application is a U.S. National Stage Filing under 35 U.S.C. 371 from International Application No. PCT/JP2009/007053, filed on Dec. 21, 2009, and published as WO 2010/103599 on Sep. 16, 2010, which claims priority under 35 U.S.C. 119 to Japanese Application No. 2009-058835, filed Mar. 12, 2009, which applications and publication are incorporated herein by reference in their entirety.

TECHNICAL FIELD

The present invention relates to a thermal protector having superiority in electric current responsiveness or thermal responsiveness with a simple configuration that does not need a separate manufacturing step of incorporating a resistor.

BACKGROUND ART

Thermal protectors that open/close a contact by inverting and driving a bimetal with Joule heat produced by an applied current are known as conventional techniques.

Most of these thermal protectors incorporate a resistor, such as a film resistor (for example, see Patent Document 1), a metal wire resistor (for example, see Patent Document 2) or the like, for producing Joule heat as an additional component in order to take measures in response to not only an increase of an ambient temperature but an overcurrent.

PRIOR ART DOCUMENTS

Patent Documents

Patent Document 1: Patent No. 3393981

Patent Document 2: Japanese Laid-open Patent Publication No. 2003-141977

SUMMARY OF THE INVENTION

Problems to be Solved by this Invention

However, the conventional techniques referred to in Patent Document 1, 2 and the like have an unavoidable problem of an increase in not only the price of a resistor as an additional component but the price of an entire thermal protector because a manufacturing step of assembling the resistor as an additional component is needed as an additional step.

Means for Solving the Problems

In order to solve the above described problem, the thermal protector according to the present invention is a thermal protector for opening/closing an electric circuit with a bimetal having a warpage direction that is inverted at a predetermined temperature in response to a change of an ambient temperature. The thermal protector includes: a fixed conductor having a fixed contact provided at one end, and a first terminal for an external connection; an insulator, provided between the fixed contact and the first terminal of the fixed conductor, having columns integrally formed by being resin-molded; a movable plate having a fixed part having holes into which the columns are inserted on the insulator, a movable contact formed at a position facing the fixed contact at an end on a side opposite to the fixed part, and hooks for holding the bimetal respectively on a movable end side and a fixed end side; the bimetal, held by the hooks of the movable plate, for opening/closing the movable contact and the fixed contact by inverting the warpage direction at the predetermined temperature; and a resinous block for fixing the fixed part to the insulator by being inserted with the columns above the fixed part of the movable plate having the holes into which the columns are inserted. In the thermal protector, the movable plate makes the movable contact touch the fixed contact with a predetermined spring property in a normal state, and the movable plate has a slim hole, formed by being cut from the fixed part toward the movable contact at a position closer to one of sides from a central line along the central line that links the movable contact and the fixed part, for partitioning the movable part into a wide-width part and a narrow-width part, and for further partitioning the fixed part up to an end consecutively to the partitioning, and a second terminal, connected to the end consecutive to the narrow-width part of the fixed part partitioned up to the end, for an external connection.

Additionally, to solve the above described problem, the thermal protector according to the present invention is a thermal protector for opening/closing an electric circuit with a bimetal having a warpage direction that is inverted at a predetermined temperature in response to a change of an ambient temperature. The thermal protector includes: a fixed conductor having a fixed contact provided at one end, and a first terminal for an external connection; an insulator, provided between the fixed contact and the first terminal of the fixed conductor, having columns integrally formed by being resin-molded; a bimetal having a fixed part having holes into which the columns are inserted on the insulator, a second terminal, formed at the fixed part, for an external connection, a movable contact formed at a position facing the fixed contact at an end on a side opposite to the fixed part, and an inversion operation part, formed by being cut at a position closer to one of sides from a central line along the central line that links the movable contact and the fixed part so that the entire bimetal excluding an arrangement portion of the movable contact is partitioned into a wide-width part and a narrow-width part, and formed by performing tapering processing to take an upwardly convex shape in the wide-width part, for performing an inversion operation at a predetermined temperature, the bimetal taking the upwardly convex shape in a normal state to make the movable contact touch the fixed contact with a predetermined spring property; and a resinous block for fixing the fixed part to the insulator by being inserted with the columns above the fixed part of the bimetal having the holes into which the columns are inserted.

Furthermore, to solve the above described problem, the thermal protector according to the present invention is a thermal protector for opening/closing an electric circuit with a bimetal having a warpage direction that is inverted at a predetermined temperature in response to a change of an ambient temperature. The thermal protector includes: a fixed conductor having a fixed contact provided at one end, and a first terminal for an external connection; an insulator, provided between the fixed contact and the first terminal of the fixed conductor, having columns integrally formed by being resin-molded; a movable plate having a fixed part having holes into which the columns are inserted on the insulator, a movable contact formed at a position facing the fixed contact at an end on a side opposite to the fixed part, and hooks for holding the bimetal respectively on a movable end side and a fixed end side, the movable plate making the movable contact touch the fixed contact with a predetermined spring property in a normal state; the bimetal, held by the hooks of the movable plate, for opening a contact between the movable contact and the fixed contact by inverting the warpage direction at the predetermined temperature; and a resinous block for fixing the fixed part to the insulator by being inserted with the columns above the fixed part of the movable plate having the holes into which the columns are inserted. In the thermal protector, the movable plate includes a slim hole, formed by being cut from the fixed part toward the movable contact at a position closer to one of sides from a central line along the central line that links the movable contact and the fixed part, for partitioning the movable plate into a wide-width part and a narrow-width part, and for further partitioning the fixed part up to an end consecutively to the partitioning, a second terminal connected to the end on the side of the fixed part consecutive to the narrow-width part, and a third terminal connected to the end on the side of the fixed part consecutive to the wide-width part.

Effects of the Invention

According to the present invention, at a stage of press processing for cutting a movable plate or a bimetal from an original material, a narrow-width part can be used as a resistor only by forming a slim hole for partitioning the movable plate or a bimetal body part into a wide-width part and the narrow-width part. This achieves an effect such that a thermal protector having superiority in current responsiveness or thermal responsiveness with a simple configuration that does not need a separate manufacturing step of incorporating a resistor can be provided.

BEST MODE OF CARRYING OUT THE INVENTION

Embodiments according to the present invention are described in detail below.

Embodiment 1

Figure 1:
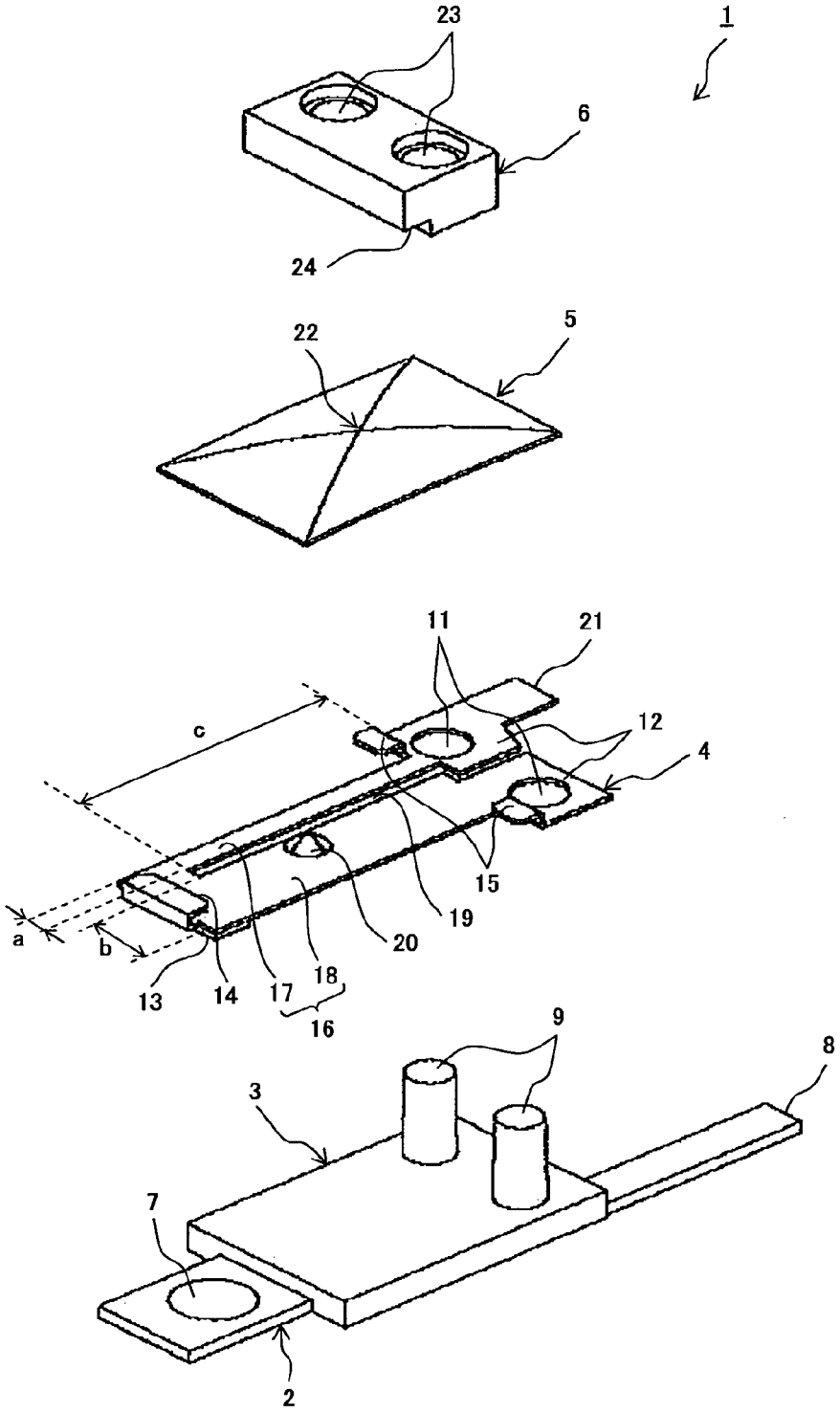
FIG. 1 is an exploded perspective view illustrating a structure of a thermal protector according to an embodiment 1 of the present invention.

FIG. 1 is an exploded perspective view illustrating a structure of a thermal protector according to an embodiment 1. As illustrated in FIG. 1, the thermal protector 1 according to this embodiment includes a fixed conductor 2, an insulator 3, a movable plate 4, a bimetal 5 and a resinous block 6.

The fixed conductor 2 has a fixed contact 7 provided at one end, and a first terminal 8, connected to an end opposite to the end provided with the fixed contact 7, for an external connection.

The insulator 3 is provided by being resin-molded between the fixed contact 7 and the first terminal 8 of the fixed conductor 2. The insulator 3 has two columns that are integrally formed by being resin-molded.

The movable plate 4 has a fixed part 12 having holes 11 into which the columns 9 are inserted on the insulator 3, a movable contact 13 formed at a position facing the fixed contact 7 of the fixed conductor 2 at an end on a side opposite to the fixed part 12, and one hook 14 and two hooks 15, which respectively hold the bimetal 5 on a movable end side provided with the movable contact 13 and a fixed end side provided with the fixed part 12.

Additionally, a slim hole 19, formed by being cut from the fixed part 12 toward the movable contact 13 at a position closer to one (the upwardly left direction in FIG. 1) of sides from a central line along the central line that links the movable contact 13 and the fixed part 12, for partitioning a movable plate body part 16 into a narrow-width part 17 and a wide-width part 18 is provided on the movable plate 4.

The slim hole 19 further partitions the fixed part 12 almost at a center up to the end consecutive to the above described partitioned narrow-width part 17 and wide-width part 18. To the movable plate 4, a second terminal 21 for an external connection is connected to the end consecutive to the narrow-width part 17 of the fixed part 12 partitioned up to the end. Moreover, on the wide-width part 18, a protrusion 20 is formed at a portion that touches almost the center of the movable plate 16.

The bimetal 5 is formed by drawing compound processing so that a central part 22 takes an upwardly convex shape at a normal temperature as illustrated in FIG. 1, and its warpage direction is inverted so that the central part 22 takes the upwardly concave shape at a predetermined temperature higher than the normal temperature.

The resinous block 6 has penetration holes 23 into which the columns 9 of the insulator 3 are inserted, and a level difference part 24 that serves as an escape part from the hooks 15 on the side of the fixed end of the movable plate 4 upon completion of the entire assembly is formed at a bottom.

To assemble the components illustrated in FIG. 1, the movable plate 4 is initially assembled to the fixed conductor 2 where the central part is insulated with the insulator 3 by inserting the columns 9 of the insulator 3 into the holes 11 of the fixed part 12 of the movable plate 4.

Next, the bimetal 5 is assembled to the movable plate 4 by engaging both ends (the end in the lower left direction and the end in the upper right direction in FIG. 1) of the bimetal 5 with the one hook 14 and the two hooks 15 of the movable plate 4.

Then, the fixed part 12 of the movable plate 4 is fixed to the insulator 3 by being pressed by the resinous block 6 with an insertion of the columns 9 of the insulator 3 into the penetration holes 23 of the resinous block 6, and tips of the columns 9 made of resin are melted to press down the resinous block 6 with the columns 9, so that the resinous block 6 is fixed to the insulator 3.

The assembly is completed in this way. In this state, namely, in the normal state, the movable contact 13 of the movable plate 4 touches the fixed contact 7 of the fixed conductor 2 with a predetermined pressure by means of a spring property possessed by the wide-width part 18 of the movable plate body part 16. The spring property possessed by the wide-width part 18 is set so that the contact pressure generated at this time is, for example, 98 mN (milli Newton).

Additionally, the bimetal 5 warps in the upwardly convex state in the normal state (at a normal temperature) as described above (as illustrated in FIG. 1), and its central part slightly touches the protrusion 20 of the movable plate 4. Moreover, the bimetal 5 inverts its warpage direction to an upwardly concave shape in response to a change of an ambient temperature to an inversion operation temperature specific to the bimetal 5 or higher.

The ambient temperature rises because the narrow-width part 17 of the movable plate 4 is arranged in an electric circuit formed between the first terminal 8 and the second terminal 21 via the movable contact 13 and the fixed contact 7, and the narrow-width part 17 operates as a resistor when a current is applied to a long portion having a small cross-section of the narrow-width part 17.

Namely, the narrow-width part 17 serves as both a conductor and the resistor when power is applied. Moreover, the narrow-width part 17 operates as the resistor when an applied current becomes an overcurrent, so that Joule heat equal to or higher than the inversion operation temperature specific to the bimetal 5 is generated. As a result, the bimetal 5 is inverted.

With the above described inversion of the bimetal 5, the bimetal 5 lifts up the side of the end provided with the one hook 14, namely, the end provided with the movable contact 13 of the movable plate 4 according to the principle of leverage that uses the protrusion 20 and the two hooks 15 respectively as a fulcrum and pressing portions. As a result, the contact between the movable contact 13 and the fixed contact 7 is opened, whereby power applied to the electric circuit formed between the first terminal 8 and the second terminal 21 is interrupted.

Selecting a material having a low conductivity, such as stainless steel, as a material of the above described movable plate 4 is effective for the narrow-width part 17 that operates as the resistor. Assuming that a length c of the narrow-width part 17 along the slim hole 19 illustrated in FIG. 1 is approximately 9 mm, a thickness of the movable plate 4 is 0.1 mm, and a width a of the narrow-width part 17 is 0.5 mm, a resistance value of approximately 0.2Ω is obtained with a measuring instrument.

A resistance of a conventional copper spring material without the slim hole 19 (namely, a movable plate without the narrow-width part 17) is several mΩ. By configuring the movable plate 4 in the form of the embodiment 1 illustrated in FIG. 1, it is proved that a resistance value of nearly 100 times a conventional value can be set.

Additionally, with a conventionally studied method for thinning the thickness of a movable plate, the resistance value does not increase severalfold, and at the same time, a function as a spring is damaged. Therefore, the conventional method could not be actually employed.

With the method for configuring the movable plate in the form of the embodiment 1 according to the present invention, the wide-width part 18 partitioned by the slim hole 19 has a sufficient thickness. Therefore, the wide-width part 18 can be sufficiently used as a spring. Moreover, the spring property is not deteriorated by overheat because a current is not applied to the wide-width part 18. Therefore, a thermal protector having a high resistance can be provided while maintaining performance as a switch.

It is said that the above described function as a spring is normally sufficient as a silver contact if the contact pressure is equal to or higher than 98 mN, and the contact pressure can be also adjusted with a width partitioned by the slim hole.

Namely, if a ratio "a:b" of the width a of the narrow-width part 17 to the width b of the wide-width part 18, which are partitioned by the slim hole 19, is equal to or larger than "1:2" (namely, "a/b"≤"½") although it depends on the thickness of the movable plate, it is proved as a result of various experiments that the spring property of the wide-width part 18 that operates as a spring is not affected by the narrow-width part 18 that operates as a resistor and the wide-width part 18 can stably operate as a spring.

If the ratio of the width a of the narrow-width part 17 to the width b of the wide-width part 18 is set to "1:1", also the spring property of the narrow-width part 17 that operates as the resistor is strengthened. However, the narrow-width part 17 that operates as the resistor is significantly deteriorated, leading to a possibility that the entire property change exceeds a tolerable range. Accordingly, it is preferable to set "a/b"≤"½".

As described above, according to the embodiment 1, a high internal resistance can be set in the same configuration as a conventional component, and the internal resistance is not incorporated as an additional component in the thermal protector. This achieves an advantage of suppressing processing cost.

Additionally, the resistor produces heat in the neighborhood of the bimetal compared with the conventional form of adding a resistor to a thermal protector. Therefore, a thermal protector having high thermal responsiveness of the bimetal, namely, a thermal protector having high thermal responsiveness is realized.

Furthermore, even in the form of arranging the resistor part in the same component as described above, the spring part (wide-width part) and the resistor part (narrow-width part) are physically partitioned by the slim hole, and a current is not applied to the spring part. This can minimize the deterioration of the spring property, whereby a highly reliable thermal protector can be obtained.

Setting of an association between the above described inversion operation temperature specific to the bimetal 5 and the narrow-width part 17 that produces Joule heat equal to or higher than the inversion operation temperature can be adjusted by initially increasing/decreasing a length c from the fixed part 12 of the narrow-width part 17 to the movable contact 13 in FIG. 1.

Figure 2:
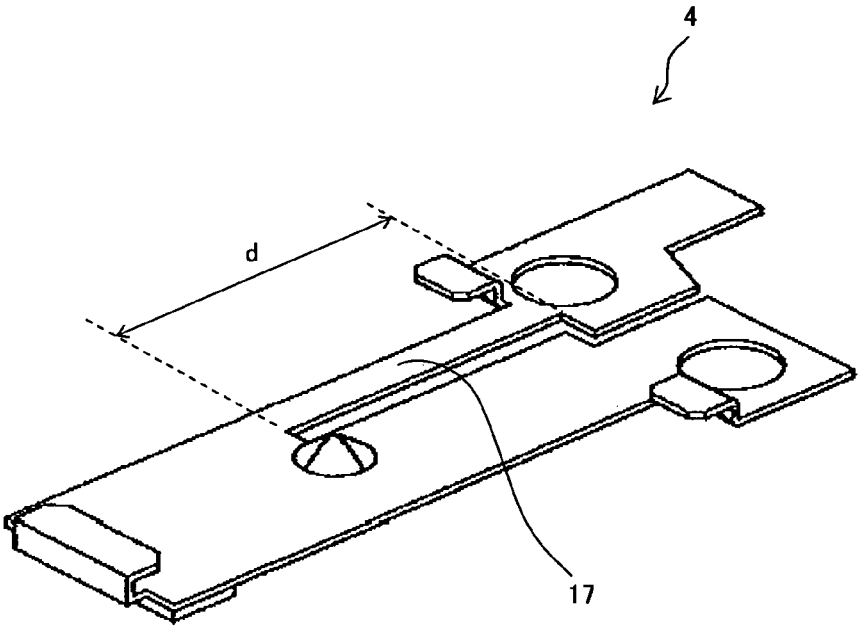
FIG. 2 illustrates a state where a length of a narrow-width part is formed to be shorter, namely, approximately one half of a length of the embodiment 1 as a modification example 1 of the thermal protector according to the embodiment 1 of the present invention.

FIG. 2 illustrates a modification example 1 of the embodiment 1, and illustrates a state where the length of the narrow-width part 17 is formed to be shorter than the length c of FIG. 1, namely, a length d of approximately one half. If the length of the narrow-width part 17 of the movable plate 4 is set to ½ in this way, Joule heat drops to one half with a simple calculation compared with the case of the original length illustrated in FIG. 1. As a result, a higher current can be applied to the thermal protector 1.

Figure 3:
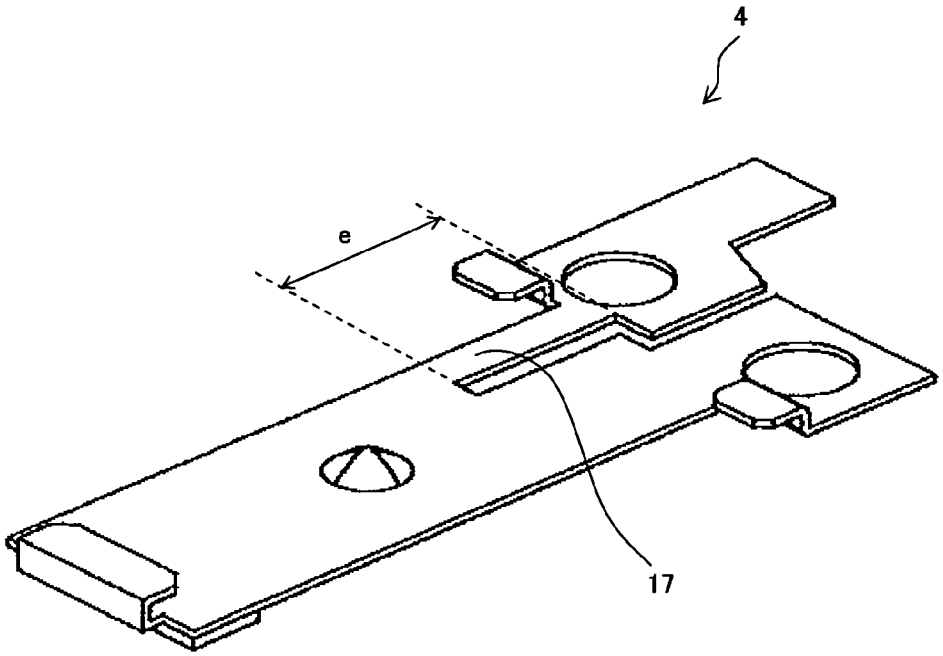
FIG. 3 illustrates a state where the length of the narrow-width part is formed to be shorter, namely, approximately one quarter of the length of the embodiment 1 as a modification example 2 of the thermal protector according to the embodiment 1 of the present invention

FIG. 3 illustrates a modification example 2 of the embodiment 1, and illustrates a state where the length of the narrow-width part 17 is formed to be shorter than the length c of FIG. 1, namely, a length e of approximately one quarter. If the length of the narrow-width part 17 of the movable plate 4 is set to be one quarter as described above, Joule heat drops to one quarter with a simple calculation compared with the case of the original length illustrated in FIG. 1. As a result, a higher current can be applied to the thermal protector 1.

Figure 4:
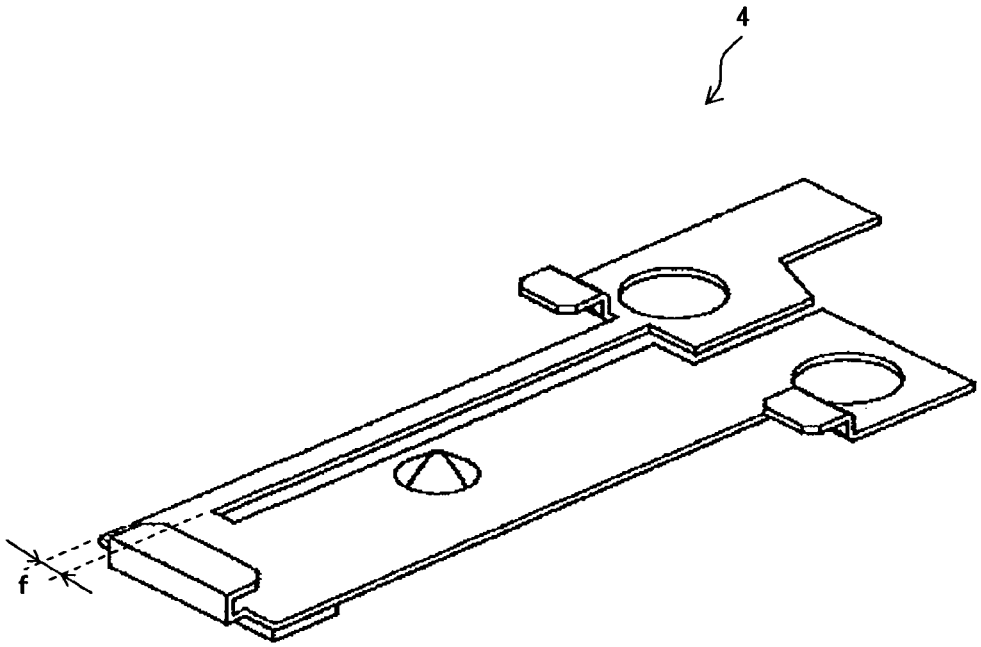
FIG. 4 illustrates a state where a width of the narrow-width part is formed to be narrower, namely, approximately one half of a width of the embodiment 1 as a modification example 3 of the thermal protector according to the embodiment 1 of the present invention

FIG. 4 illustrates a modification example of the embodiment 1, and illustrates a state where the width of the narrow-width part 17 is formed to be narrower than the width a of FIG. 1, namely, a width f of approximately one half. If the width of the narrow-width part 17 of the movable plate 4 is set to one half in this way, Joule heat is doubled with a simple calculation compared with the case of the original width illustrated in FIG. 1. As a result, a current can be interrupted with a lower overcurrent.

Additionally, if the width of the narrow-width part 17 is narrowed as described above, a temperature of the narrow-width part 17 as a resistor becomes very high when an overcurrent of, for example, ten times a rated current is applied. In this case, the narrow-width part 17 interrupts applied power by melting itself with its Joule heat before the contact is opened by the inversion of the bimetal 5. The thermal protector can be configured also in this way.

Figure 5:
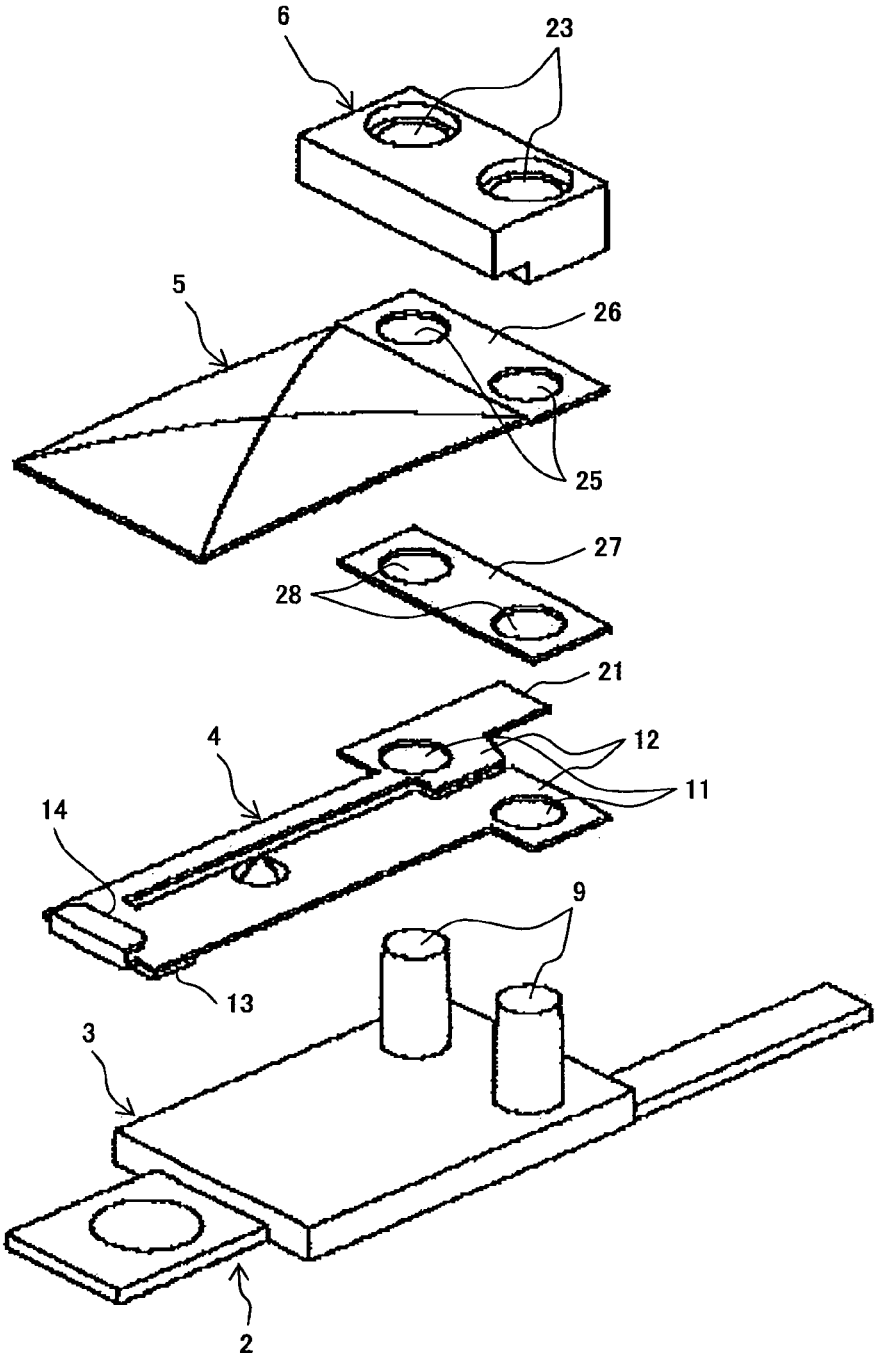
FIG. 5 illustrates another example of a method for installing a bimetal element as a modification example 4 of the thermal protector according to the embodiment 1 of the present invention.

FIG. 5 illustrates a modification example 4 of the embodiment 1, namely, another example of the method for installing the bimetal 5. The same components in FIG. 5 as those of the configuration illustrated in FIG. 1 or 4 are denoted with the same reference numerals as those of FIG. 1 or 4.

As illustrated in FIG. 5, in the modification example 4, the movable plate 4 has only the hook 14 formed on the movable end side, namely, at the end provided with the movable contact 13, and the two hooks 15 provided on the side of the fixed part in the embodiment 1 of FIG. 1 are removed.

The bimetal 5 has a fixed part 26 where holes 25, into which the columns 9 of the fixed conductor 2 are inserted, are formed at the end on the fixed side as a replacement for the removed two hooks 15.

For the bimetal 5 according to this embodiment, its end (the end in the lower left direction of FIG. 5) that moves when the bimetal 5 is inverted in the warpage direction is held by the hook 14, and the fixed part 26 is fixed to the fixed part 12 of the movable plate 4 by the resinous block 6 via an insulation sheet 27 (where holes 28 into which the columns 9 of the fixed conductor 2 are inserted) newly provided in this embodiment. Operations performed for an overcurrent are similar to those of the embodiment 1.

Embodiment 2

Figure 6:
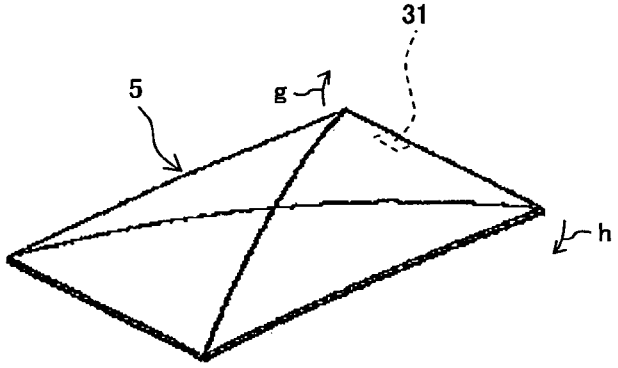
FIG. 6 is a perspective view illustrating a structure of a movable plate of a thermal protector according to an embodiment 2 of the present invention.
Figure 6:
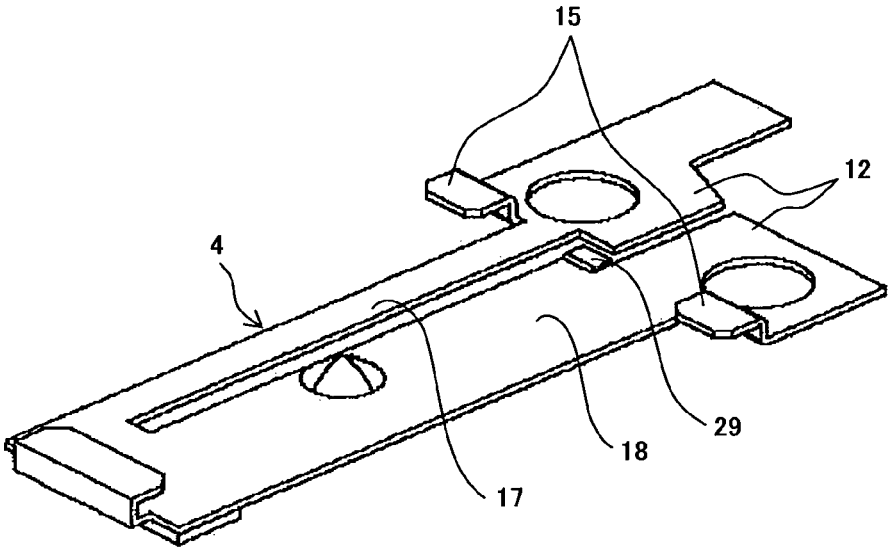

FIG. 6 is a perspective view illustrating a structure of a movable plate of a thermal protector according to an embodiment 2 of the present invention. FIG. 6 also illustrates, above the movable plate 4, a bimetal 5 that operates according to the structure of the movable plate 4.

On the movable plate 4 in this embodiment, a protrusion 29 higher by one level is provided in a portion closer to the narrow-width part 27 at the root on the side of the wide-width part 18. If the protrusion 29 is closer to the side of the narrow-width part 17 as described above, a point 31 closer to the narrow-width part 17 from the middle of the end on the fixed side of the bimetal 5 touches the protrusion 29 when the end on the fixed side of the bimetal 5 engages with the hooks 15 on the fixed side of the movable plate 4.

As a result, the end on the fixed side of the bimetal 5 tilts to the side of the wide-width part 18 as indicated by arrows g and h in terms of balance with respect to the protrusion 29 as a fulcrum of a seesaw. Accordingly, the end on the fixed side of the bimetal 5 can be prevented from touching the narrow-width part 17.

This can overcome the problem of disabling the function of the narrow-width part 17 as a resistor due to short-circuiting of the separated fixed part 12 of the movable plate 4.

Figure 7:
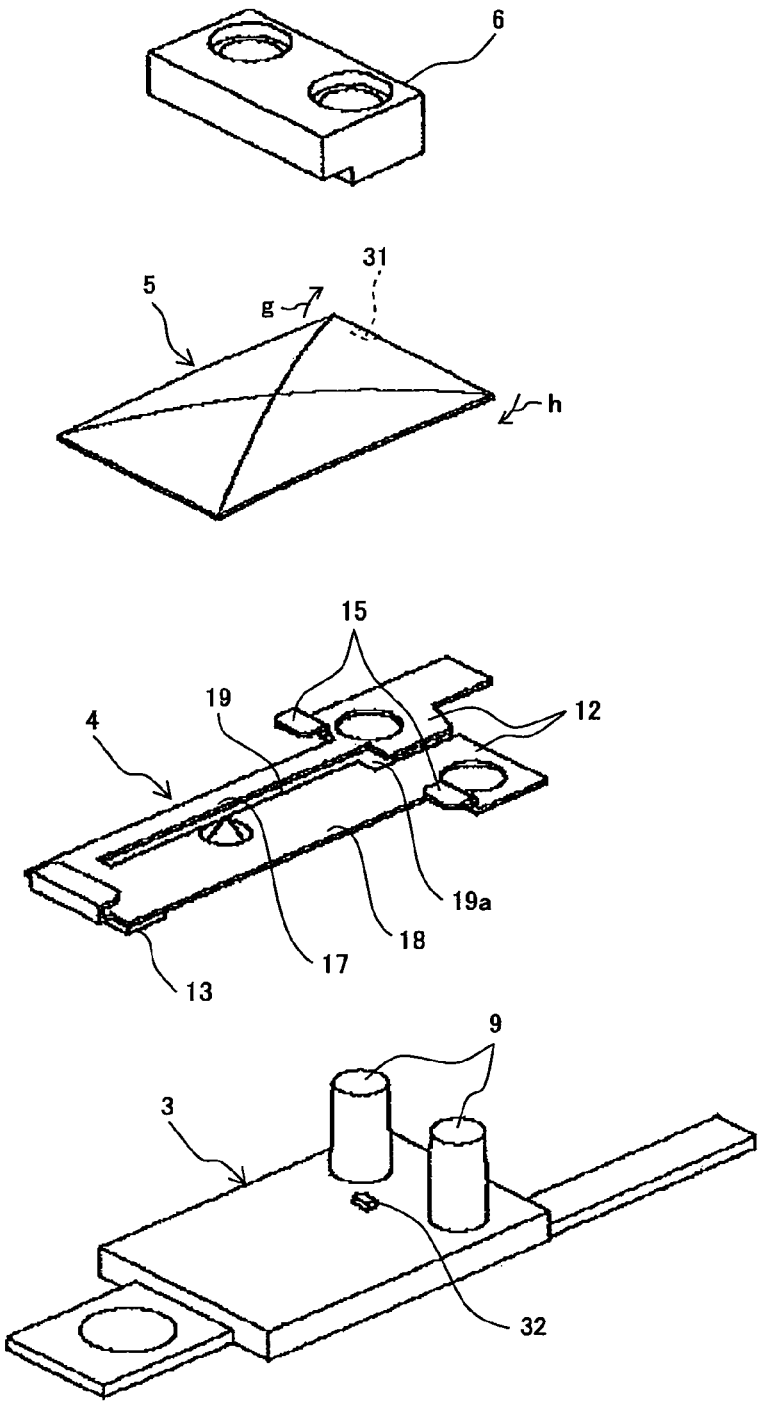
FIG. 7 is a perspective view illustrating a structure of an insulator as a modification example of the thermal protector according to the embodiment 2 of the present invention.

FIG. 7 is a perspective view illustrating a structure of an insulator as a modification example of the thermal protector according to the embodiment 2 of the present invention. The insulator 3 in this embodiment has a protrusion 32 at a position slightly closer to the narrow-width part 17 of the movable plate 4 from a central line in front of the columns 9.

After all the components are assembled, this protrusion 32 protrudes at a position corresponding to a line that links the hooks 15 respectively provided on both sides of the fixed end side of the movable plate 4 through the slim hole 19 (strictly, a long hole partitioning into the wide-width part 18 and the narrow-width part 17, and a consecutive portion 19*a* of a long hole that is consecutive to the long hole and partitions the fixed part 12 up to the end) that partitions the movable plate 4 into the wide-width part 18 and the narrow-width part 17.

Also in this case, the protrusion 32 that protrudes through the upper surface of the fixed part side of the movable plate 4 is closer to the side of the narrow-width part 17. Therefore, the point 31 closer to the narrow-width part 17 from the middle of the end on the fixed side of the bimetal 5 touches the protrusion 32 when the end on the fixed side of the bimetal 5 is engaged with the hooks 15 on the fixed side of the movable plate 4.

As a result, the end on the fixed side of the bimetal 5 tilts to the side of the wide-width part 18 as indicated by arrows g and h in terms of balance with respect to the protrusion 32 as a fulcrum of a seesaw. Accordingly, the end on the fixed side of the bimetal 5 can be prevented from touching the narrow-width part 17.

Note that similar effects can be achieved also by configuring the movable plate 4 to lower the top and the bottom positions of the narrow-width part 17 with bending processing performed for the hooks of the movable plate 4 toward the side of the movable contact 13 of the narrow-width part 17 when the hooks of the movable plate 4 are bended, although this is not illustrated.

Additionally, in both the embodiment 2 and its modification example, operations for interrupting a current against an overcurrent are similar to those of the embodiment 1. As described above, according to the embodiment 2 and its modification example, the end on the fixed side of the bimetal can prevent the narrow-width part as a resistor part and the wide-width part as a spring part from being short-circuited at the fixed part, whereby a stable characteristic as a thermal protector can be achieved.

Embodiment 3

Figure 8:
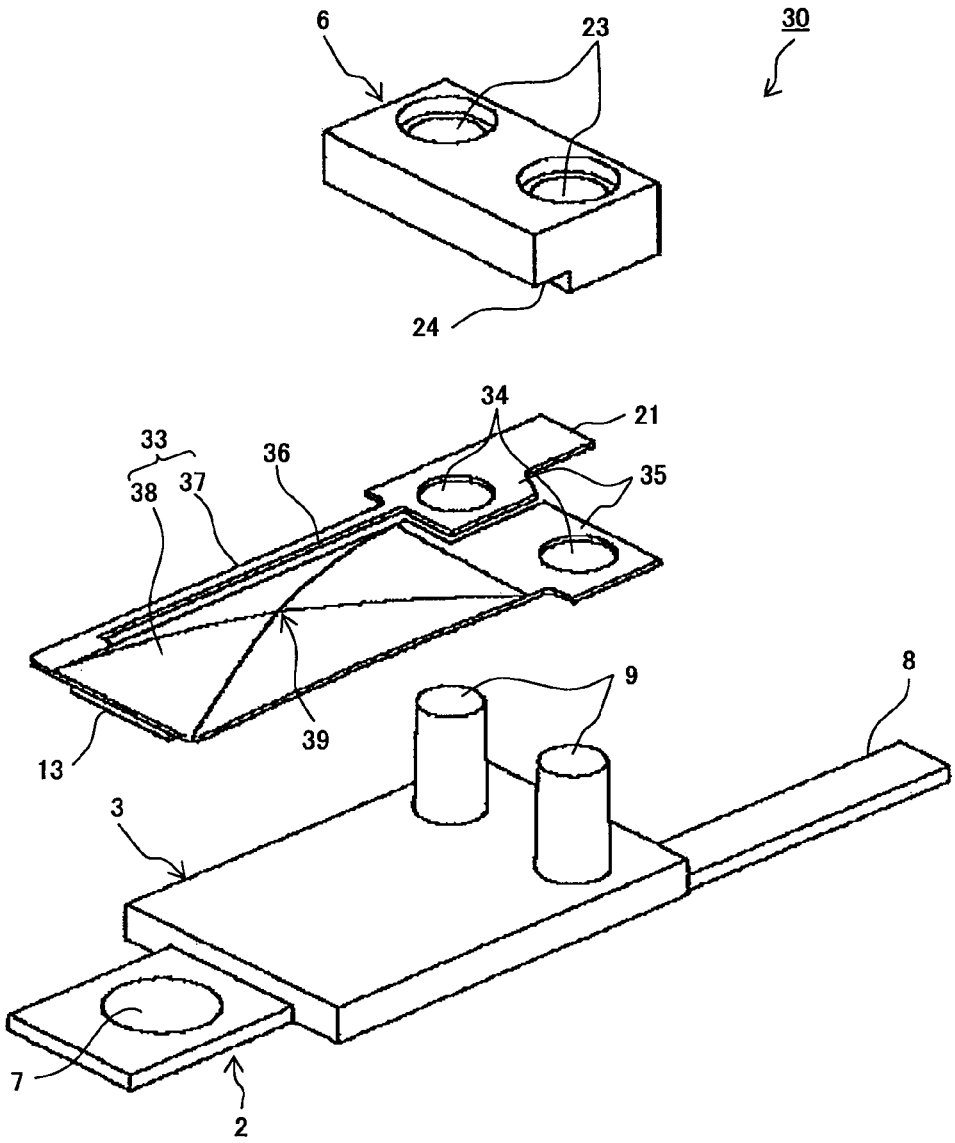
FIG. 8 is an exploded perspective view illustrating a structure of a thermal protector according to an embodiment 3 of the present invention.

FIG. 8 is an exploded perspective view illustrating a structure of a thermal protector according to an embodiment 3 of the present invention. The same components in FIG. 8 as those of FIG. 1 are denoted with the same reference numerals as those of FIG. 1. As illustrated in FIG. 8, in the thermal protector 30 in this embodiment, configurations of a fixed conductor 2, an insulator 3 and a resinous block 6 are the same as those of FIG. 1.

In the thermal protector according to this embodiment, the movable plate 4 of FIG. 1 is removed, and a bimetal 33 serves as a movable plate, a resistor and a bimetal. Namely, the thermal protector 30 according to this embodiment is an example of a structure for directly applying a current to the bimetal.

The bimetal 33 in this embodiment has a fixed part 35 having holes 34 into which the columns 9 are inserted on the insulator 3. The bimetal 33 also has a second terminal 21, formed at the fixed part 35, for an external connection, and a movable contact 13 formed at a position facing the fixed contact 7 of the fixed conductor 2 at the end on a side opposite to the fixed part 35.

Additionally, in the whole of the bimetal 33 excluding the arrangement portion of the movable contact 13, a slim hole 36 is formed at a position closer to one (in the upper left direction in FIG. 8) of the sides from a central line along the central line that links the movable contact 13 and the fixed part 35. By the slim hole 36, the bimetal 33 is partitioned into a narrow-width part 37 and a wide-width part 38 excluding the arrangement portion of the movable contact 13.

Additionally, the narrow-width part 37 is configured to serve as a conductor part in an electric circuit applied between the first terminal 8 and the second terminal 21 via the fixed contact 7 and the movable contact 13 in a normal state, and to serve as a resistor part for producing desired Joule heat when an applied current becomes an overcurrent of a predetermined value or larger. Since the bimetal itself is made of a material originally having a low conductivity, it is preferable to obtain a high resistance with the narrow-width part 37.

In the meantime, the wide-width part 38 configures an inversion operation part, formed by performing drawing compound processing 39 to take an upwardly convex shape, for performing an inversion operation at a predetermined temperature (temperature corresponding to the above described desired Joule heat). This wide-width part 38 serves as both a bimetal and a movable plate, takes the upwardly convex shape in a normal state, and makes the movable contact 13 touch the fixed contact 7 with a predetermined spring property. Note that operations for interrupting a current against an overcurrent are similar to those of the embodiment 1.

Embodiment 4

Figure 9:
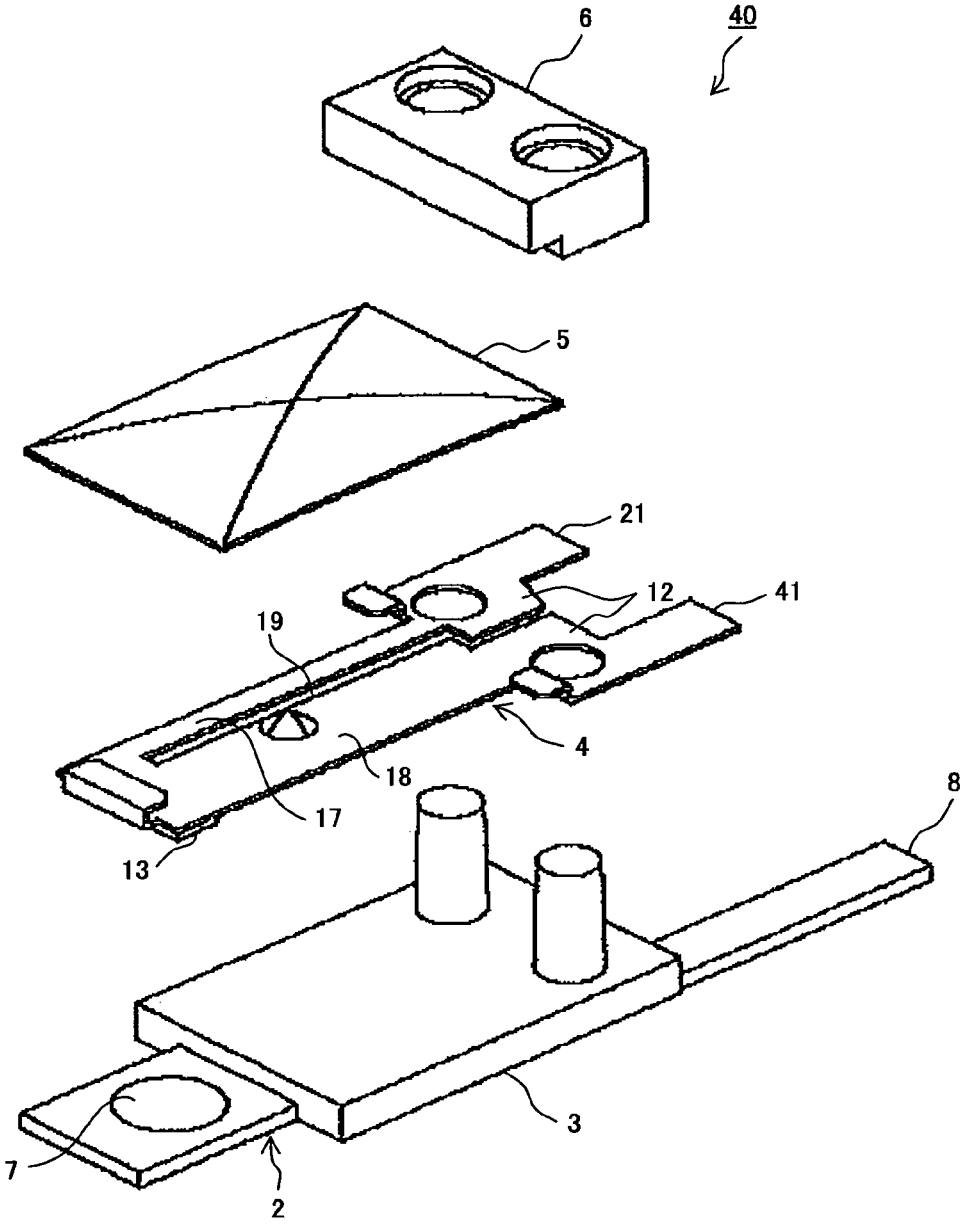
FIG. 9 is an exploded perspective view illustrating a structure of a thermal protector according to an embodiment 4 of the present invention.

FIG. 9 is an exploded perspective view illustrating a structure of a thermal protector according to an embodiment 4 of the present invention. The same components in FIG. 9 as those of FIG. 1 are denoted with the same reference numerals as those of FIG. 1. As illustrated in FIG. 9, configurations of a fixed conductor 2, an insulator 3, a bimetal 5 and a resinous block 6 are the same as those of FIG. 1 in the thermal protector 40 according to this embodiment.

Unlike the thermal protector 1 according to the embodiment 1 illustrated in FIG. 1, a new terminal is connected as a third terminal 41 to the fixed part 12 of the wide-width part 18 as well as the fixed part 12 of the narrow-width part 17 partitioned by the slim hole 19 of the movable plate 4 in the thermal protector 40 according to this embodiment.

A relationship between the third terminal 41 and the first terminal 8 of the fixed conductor 2, which are connected via the wide-width part 18, can be considered as being identical to the basic structure of conventional thermal protector terminals.

In contrast, with a relationship between the first terminal 8 and the second terminal 21, which are connected via the narrow-width part 27, an applied current produces more heat since the narrow-width part 17 as a resistor is provided in between.

A usage example of this thermal protector 40 is as follows. If a heat-resistance limit of an operating temperature of a normal thermal protector varies depending on a usage environment, measures can be taken, for example, against a temperature of heat produced by an overloaded battery.

Namely, a charging side has an unadjustable structure for the case where heat is produced by an overcharged battery. Therefore, different measures can be set such that the third terminal for an external connection is connected to the side of the wide-width part 18, and an operating temperature of the thermal protector is reduced below a predetermined temperature with a current applied to the terminal on the side of the narrow-width part 17, and the thermal protector is operated at a lower temperature.

These settings can be adjusted, for example, by varying the length partitioned by the slim hole, or the width of the narrow-width part partitioned by the slim hole in a similar manner as in the modification examples 1, 2 and 3 of the embodiment 1.

INDUSTRIAL APPLICABILITY

The present invention is applicable to a thermal protector having superiority in current responsiveness or thermal responsiveness with a simple configuration.

EXPLANATION OF CODES

1 thermal protector
2 fixed conductor
3 insulator
4 movable plate
5 bimetal element
6 resinous block
7 fixed contact
8 first terminal
9 columns
11 holes
12 fixed part
13 movable contact
14, 15 hooks
16 movable plate body part
17 narrow-width part
18 wide-width part
19 slim hole
**19*a*** slim hole consecutive part
20 protrusion
21 second terminal
22 central part
23 penetration hole
24 level difference part
25 holes
26 fixed part
27 insulation sheet

28 holes
29 protrusion
30 thermal protector
31 point closer to narrow-width part
32 protrusion
33 bimetal
34 holes
35 fixed part
36 slim hole
37 narrow-width part
38 wide-width part
39 tapering processing
40 thermal protector
41 third terminal

I claim:

1. A thermal protector for opening/closing an electric circuit with a bimetal having a warpage direction that is inverted at a predetermined temperature in response to a change of an ambient temperature, comprising:

a fixed conductor having a fixed contact provided at one end, and a first terminal for an external connection;

an insulator, provided between the fixed contact and the first terminal of the fixed conductor, having columns integrally formed by being resin-molded;

the bimetal comprising a fixed part having holes into which the columns of the insulator are inserted, a second terminal, formed at the fixed part, for an external connection, a movable contact formed at a position facing the fixed contact at an end on a side opposite to the fixed part, and an inversion operation part, formed by being cut at a position closer to one of sides from a central line along the central line that links the movable contact and the fixed part so that the entire bimetal excluding an arrangement portion of the movable contact is partitioned into a wide-width part and a narrow-width part, and formed by performing tapering processing to take an upwardly convex shape in the wide-width part, for performing an inversion operation at a predetermined temperature, the bimetal taking the upwardly convex shape in a normal state to make the movable contact touch the fixed contact with a predetermined spring property; and a resinous block for fixing the fixed part to the insulator by being inserted with the columns above the fixed part of the bimetal, the fixed part having the holes into which the columns are inserted.

2. The thermal protector according to claim 1, wherein the narrow-width part is used as both a conductor and a resistor when power is applied to a contact point between the movable contact and the fixed contact.

* * * * *